US007614512B2

(12) United States Patent
Nader

(10) Patent No.: US 7,614,512 B2
(45) Date of Patent: Nov. 10, 2009

(54) BEVERAGE BOTTLE WITH STORAGE COMPARTMENT

(76) Inventor: Nowzari Nader, 40 Future Avenue, Richmond, ON (CA) L4S 1S8

( * ) Notice: Subject to any disclaimer, the term of this patent is extended or adjusted under 35 U.S.C. 154(b) by 0 days.

(21) Appl. No.: 11/987,848

(22) Filed: Dec. 5, 2007

(65) Prior Publication Data

US 2008/0128378 A1 Jun. 5, 2008

Related U.S. Application Data

(60) Provisional application No. 60/872,803, filed on Dec. 5, 2006.

(51) Int. Cl.
*B65D 1/04* (2006.01)
*B65D 1/06* (2006.01)

(52) U.S. Cl. ..... 215/6; 215/10; 206/217; 220/506

(58) Field of Classification Search ..... 215/6, 215/10, 386; 206/217, 459.5; 220/500, 506
See application file for complete search history.

(56) References Cited

U.S. PATENT DOCUMENTS

| | | | | | |
|---|---|---|---|---|---|
| 1,728,853 | A * | 9/1929 | Byles | 318/268 |
| 1,918,308 | A * | 7/1933 | Webber | 215/6 |
| 2,274,973 | A * | 3/1942 | Bryant | 215/12.1 |
| 3,590,989 | A * | 7/1971 | Wittwer | 206/568 |
| 3,741,383 | A * | 6/1973 | Wittwer | 206/219 |
| 5,881,868 | A * | 3/1999 | Soyak et al. | 206/213.1 |
| D478,511 | S * | 8/2003 | Reynolds | D9/502 |
| 6,989,168 | B2 * | 1/2006 | Fahey | 426/120 |
| 2006/0150450 | A1 * | 7/2006 | Azouri | 40/310 |
| 2006/0213854 | A1 * | 9/2006 | Singh et al. | 215/6 |
| 2007/0090077 | A1 * | 4/2007 | Graber | 215/10 |

* cited by examiner

*Primary Examiner*—Sue A Weaver

(57) ABSTRACT

A beverage bottle consisting of a body portion for containing a liquid beverage, the body portion having a sidewall portion extending between a neck portion and a base portion, a storage compartment forming a cavity within the body portion, the cavity extending from the base portion vertically towards the neck portion of the body portion, and one or more promotional products disposed and stored within the cavity of the storage compartment.

3 Claims, 5 Drawing Sheets

BEVERAGE BOTTLE WITH STORAGE COMPARTMENT

FIELD OF THE INVENTION

The present invention relates generally to beverage bottles and, more specifically, to a beverage bottle with a storage compartment for storing one or more promotional products.

BACKGROUND OF THE INVENTION

Promotional products are commonly used by businesses to increase public awareness of their goods and services. In respect to packaged foods, such as cereals and potato chips, manufacturers can easily include the promotional products within the packaging at the time of manufacture. Following the purchase of such packaged foods, the user may open the packaging and remove the promotional product for their use and enjoyment. Thus far, manufacturers have not been provided with a suitable approach for providing promotional products with liquid beverages. An existing approach is to secure the promotional product to a hang tag around the neck portion of the beverage bottle when the liquid beverage is offered to the general public. Manufacturers have discovered that this approach is problematic for the reason that consumers may easily remove the promotional product from the beverage bottle without having to purchase the associated beverage bottle.

Promotional products are increasingly used at sporting and entertainment events to encourage spectators to attend and support the participants in the subject event. In view of the increased security conditions at most public sporting and entertainment events, spectators are routinely not permitted to bring banners and other novelty promotional products to the events. Without banners or novelty promotional products, spectators are often unable to fully enjoy and participate in the excitement of sporting and entertainment events.

In view of the foregoing, there is a need for an improved beverage bottle having a storage compartment for storing one or more promotional products. The beverage bottle of the present invention may be offered by manufacturers and other businesses to enable users, such as spectators, to utilize the one or more promotional products and to actively participate in the sporting or entertainment event, for example. The beverage bottle of the present invention may also be used by a user in a conventional manner to quench their thirst and thereby further enhance their enjoyment of the sporting or entertainment event.

SUMMARY OF THE INVENTION

The present invention comprises of a beverage bottle having a body portion for containing a liquid beverage, the body portion having a sidewall portion extending between a neck portion and a base portion, a storage compartment forming a cavity within the body portion, the cavity extending from the base portion vertically towards the neck portion of the body portion, and one or more promotional products disposed and stored within the cavity of the storage compartment. The storage compartment has a cavity wall portion extending from the base portion into the body portion, the cavity wall portion defining the cavity for storing the one or more promotional products. The length of the cavity is substantially equal to the length of the body portion. The cavity has an open end and a closed end, the open end is proximate to the base portion and the closed end is proximate to the neck portion of the body portion. The closed end of the storage compartment is formed with an optional spring biasing mechanism for urging the one or more promotional products towards the open end of the storage compartment.

In a further aspect of the present invention, the base portion of the beverage bottle is formed with a central aperture, the central aperture defines the open end of the storage compartment. A seal is provided to cover the central aperture and secure the one or more promotional products within the storage compartment. The one or more promotional products are dimensioned to be received within the storage compartment.

In a first embodiment of the present invention, the one or more promotional products may comprise of a banner adapted to be removed from the storage compartment and unfurled. The banner is furled around one or more telescopic members and stored within the storage compartment.

In a second embodiment of the present invention, the one or more promotional products comprise a miniature beverage bottle adapted to be stored within the storage compartment. The miniature beverage bottle containing a liquor beverage, the miniature beverage bottle adapted to be removed from the storage compartment and combined with the liquid beverage in the body portion to form a mixed liquid beverage.

BRIEF DESCRIPTION OF THE DRAWINGS

For a better understanding of the present invention, and to show more clearly how it may be carried into effect, reference will now be made, by way of example, to the accompanying drawings, in which.

DETAILED DESCRIPTION OF THE INVENTION

Figure 1:
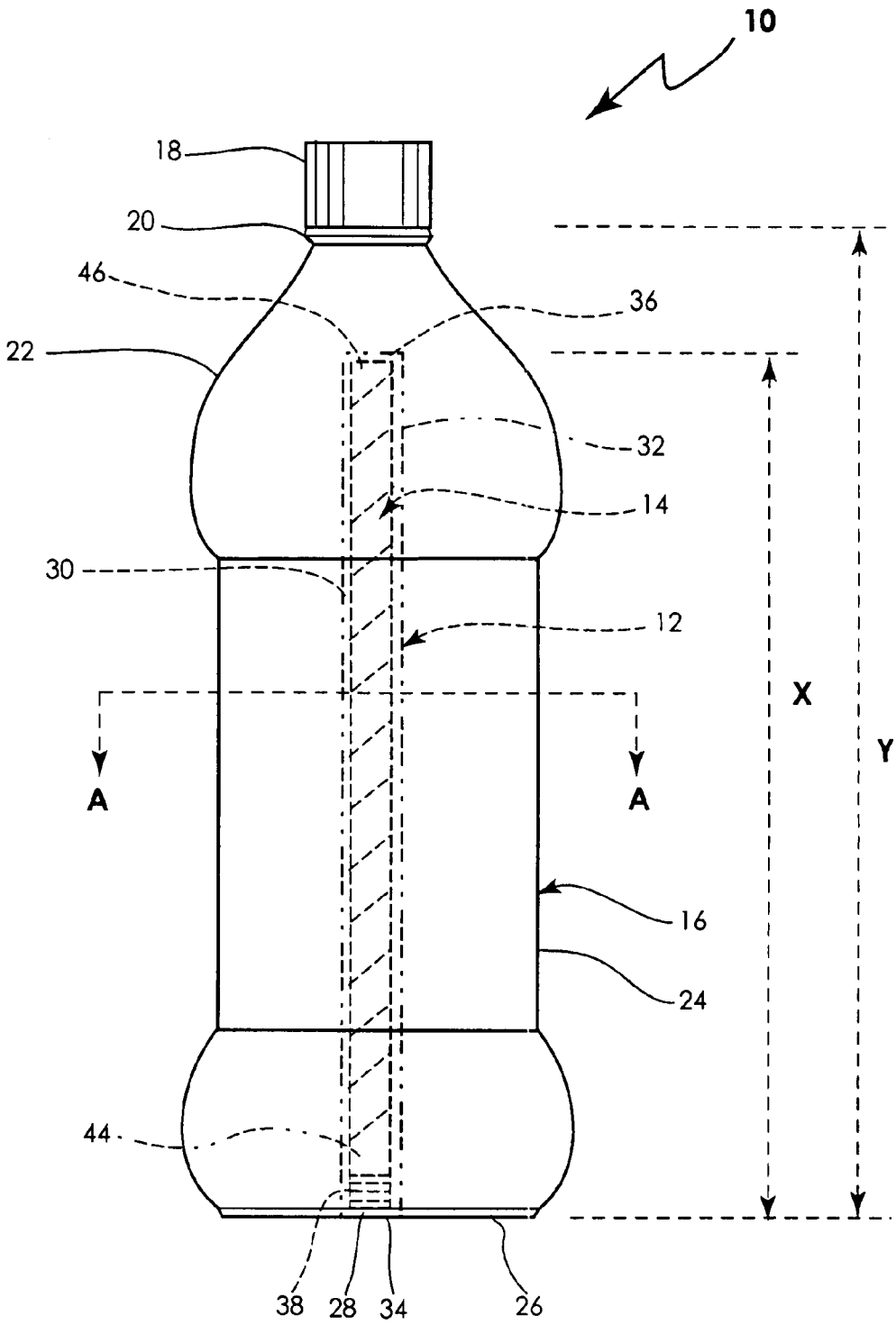
FIG. 1 is a perspective view of a beverage bottle illustrating a storage compartment for containing one or more promotional products in a preferred embodiment of the present invention.
Figure 2:
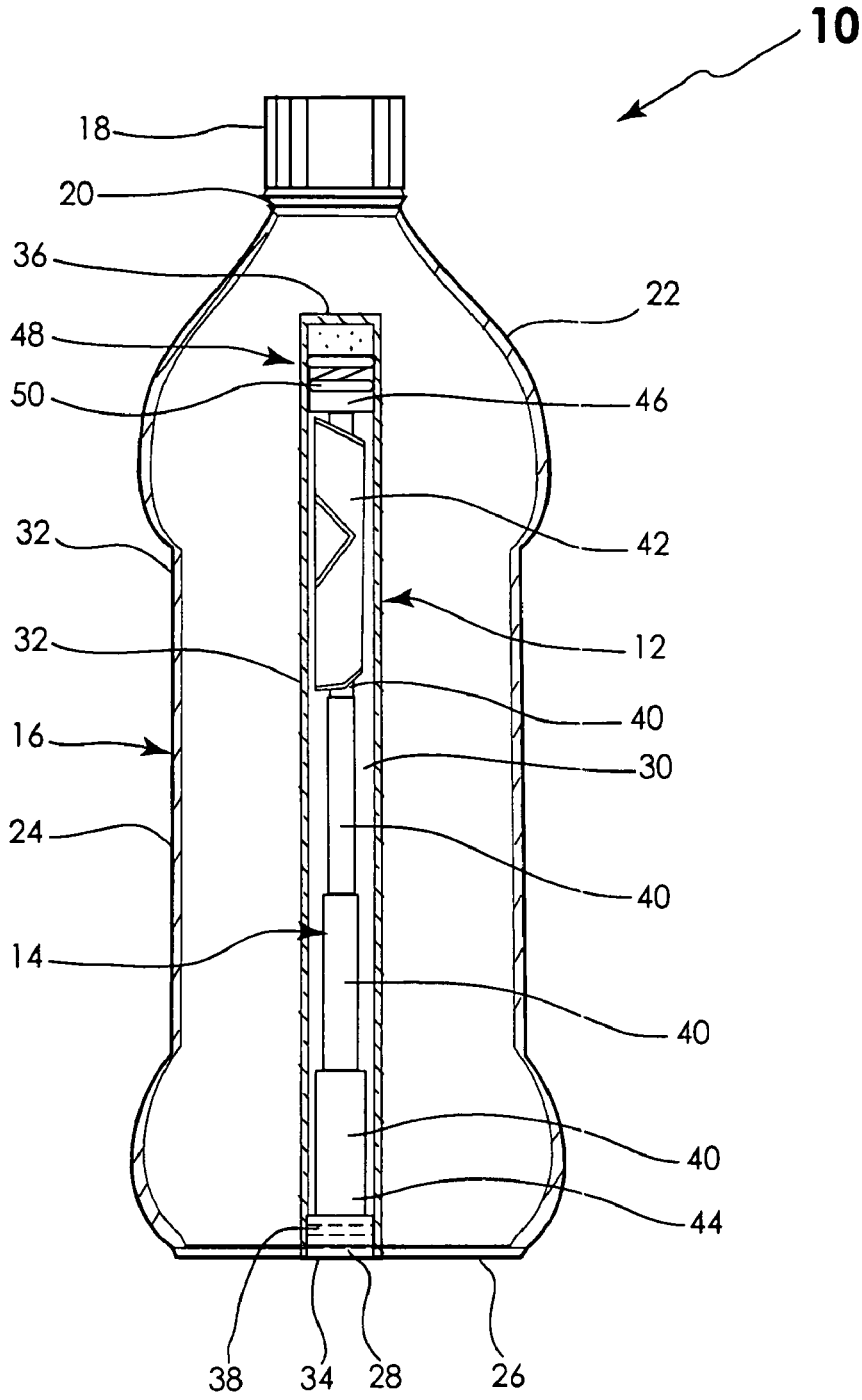
FIG. 2 is front cross-sectional view of the beverage bottle illustrated in FIG. 1 and showing the storage compartment and the one or more promotional products in accordance with a first embodiment of the present invention.
Figure 3:
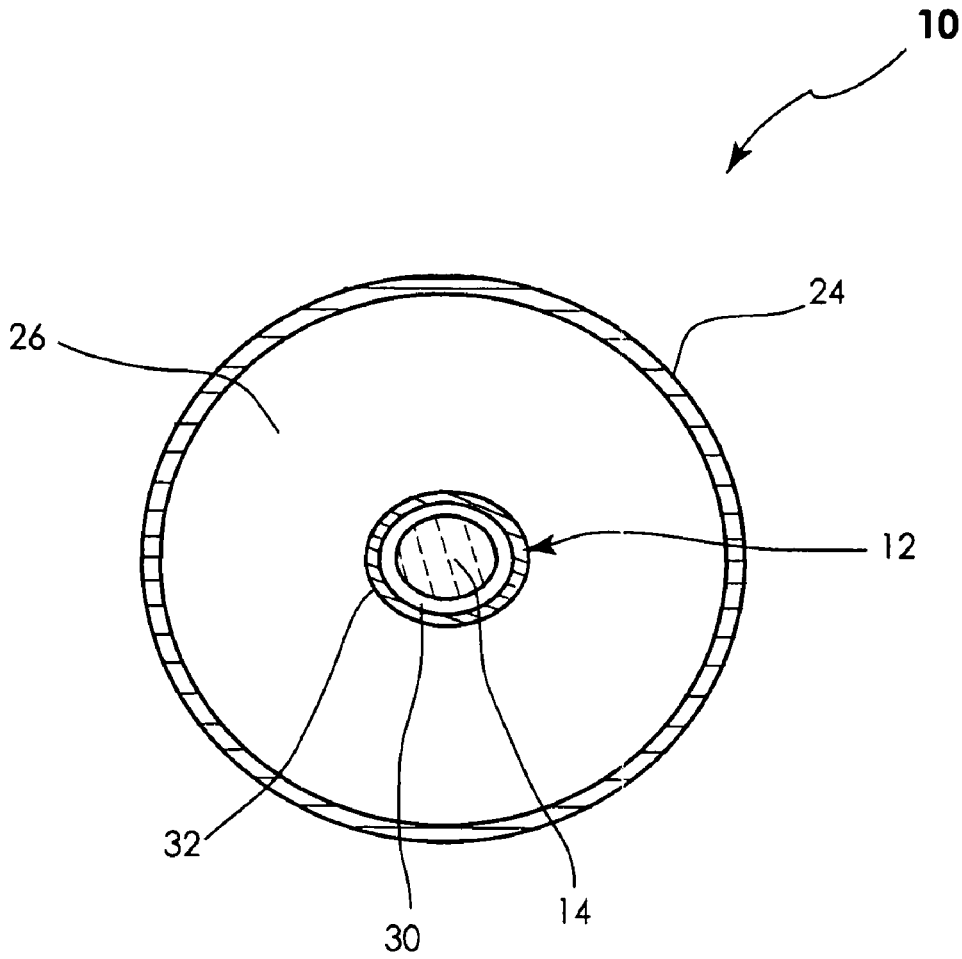
FIG. 3 is a cross-sectional plan view of the beverage bottle along the Section A-A in FIG. 1 and showing the storage compartment and the one or more promotional products.

Reference is made to FIGS. 1-3 which illustrate a beverage bottle 10 constructed with a storage compartment 12 for containing and storing one or more promotional products 14 in accordance with an embodiment of the present invention. The beverage bottle 10 of the present invention has a body portion 16 for holding a liquid beverage. The body portion 16 has a lid or cap 18 releasably coupled to a neck portion 20 which, when removed, enables a user to drink or pour the liquid beverage from the beverage bottle 10. The lid or cap 18 may be coupled to the neck portion 20 using any suitable fastening mechanism, such as a threaded fastening mechanism or a snap-fit fastening mechanism. The neck portion 20 is formed with a generally sloping shoulder portion 22 which merges with a cylindrical sidewall portion 24. The cylindrical sidewall portion 24 extends to a base portion 26 which is adapted to support and stabilize the beverage bottle 10 when it is placed on a generally horizontal surface.

Referring to FIGS. 1-3, the base portion 26 is formed with a centrally located aperture 28. The storage compartment 12 consists of a generally cylindrical cavity 30 extending into the body portion 16 of the beverage bottle 10. The cavity 30 is formed with a cavity wall portion 32 extending vertically from an open end 34 defined by the aperture 28 to a closed end 36 proximate to the neck portion 20. The cavity wall portion 32 of the storage compartment 12 is generally parallel to the sidewall portion 24 of the body portion 16. The base portion 26 of the beverage bottle 10 may be provided with a seal 38 which covers the aperture 28 to prevent tampering with the bottle 10 and to secure the one or more promotional products 14 within the storage compartment 12. In an embodiment of the present invention, the length X of the cavity 30 is substantially equal to the length Y of the body portion 16. By this design, the cavity 30 of the storage compartment 12 is capable of storing one or more promotional products of various lengths. However, it should be understood by a person skilled in the art of the present invention that the cavity 30 may have any suitable length X and may be adapted to conform to the dimensions of the promotional product 14 to be stored therein.

Referring to FIGS. 2 and 3, the one or more promotional products 14 are designed to be initially stored within the storage compartment 12 when the beverage bottle 10 is offered and subsequently sold to a user at a sporting or entertainment venue, for example. When the beverage bottle 10 is purchased by the user, the seal 38 may be removed to permit access to the one or more promotional products 14 stored within the storage compartment 12. Once removed from the storage compartment 12, the user may then display or otherwise use the one or more promotional products 14 during the course of the sporting or entertainment venue. It should be understood that a wide variety of promotional products 14 may be provided within the storage compartment 12, including, but not limited to, banners, flags, signs, miniature beverage bottles, candies, glow sticks, rally sticks, inflatable balloons, and/or condoms.

In a first embodiment of the present invention shown in FIG. 2, the one or more promotional products 14 may include a banner, flag and/or sign, for example, that are dimensioned to be received within the storage compartment 12. Referring to FIG. 2, the one or more promotional products 14 consist of a plurality of telescopic members 40 and a banner 42 which may be unfurled and displayed by a user during a sporting or entertainment event. The banner 42 may bear information relating to the liquid beverage, the beverage manufacturer, and/or the participants in the sporting or entertainment event, for example. The banner 42 is secured to at least one of the telescopic members 40 at a top end 46 of the promotional product 14. The seal 38 may be dimensioned to have roughly the same cross-sectional area as the aperture 28 in the base portion 26 so as to ensure that the promotional product 14 is securely stored within the storage compartment 12 when not in use.

During assembly, the plurality of telescopic members 40 are press-fit or snap fit into one another to collapse the promotional product 14 into a compact size suitable for insertion into the storage compartment 12. The banner 42 is furled or rolled up around the collapsed telescopic members 40 to facilitate the manual or automated insertion of the promotional product 14 into the storage compartment 12 of the beverage bottle 10. The seal 38 may then be at least partially inserted into the aperture 28 in the base portion 26 to secure the promotional product 14 within the storage compartment 12.

When the seal 38 is removed, the banner 42 may be removed from the cavity 30 by a user grasping the bottom end 44 of the promotional product 14. To facilitate the removal of the promotional product 14 from within the storage compartment 12, an optional spring biasing mechanism 48 having a spring member 50 may be provided within the closed end 36 of the storage compartment 12 for urging the promotional product 14 towards the open end 34 of the storage compartment 12. By this design, when the seal 38 is manually removed, the promotional product 14 is at least partially urged from the open end 34 of the storage compartment 12 by the spring member 50 of the spring biasing mechanism 48.

Following the display of the promotional product 14, the user may collapse the telescopic members 40 and snugly furl the banner 42 around the one or more telescopic members 40. The promotional product 14 may then be reinserted into the storage compartment 12 and secured by the seal 38 for storage purposes.

Figure 4:
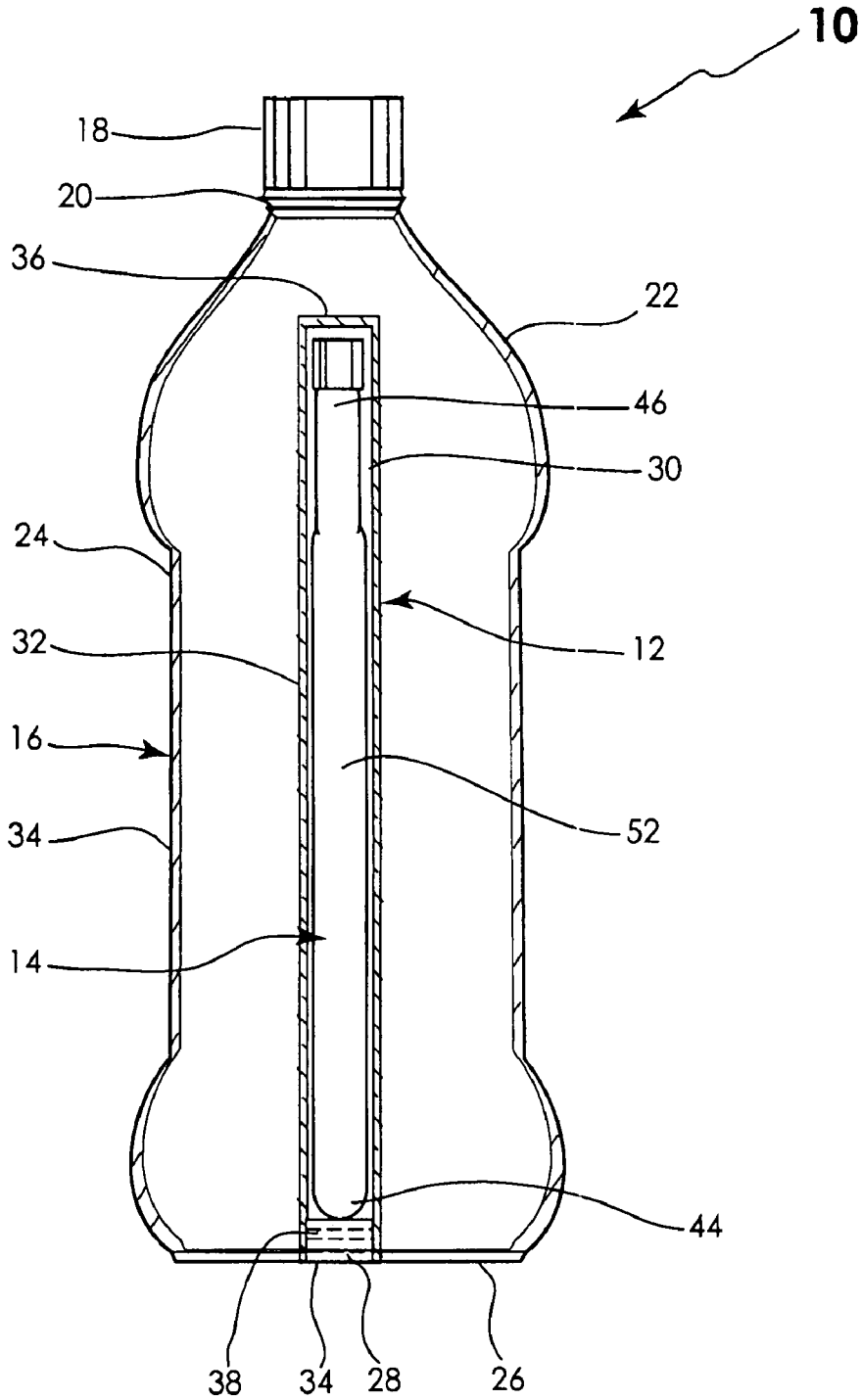
FIG. 4 is a front cross-section view of the beverage bottle illustrated in FIG. 1 and showing the storage compartment containing a miniature beverage bottle in accordance with a second embodiment of the present invention.

In a second embodiment of the present invention shown in FIG. 4, the one or more promotional products 14 are one or more miniature beverage bottles 52 containing samples of new promotional beverages offered by a beverage manufacturer. By this design, manufacturers may provide existing consumers with samples of new promotional beverages together with the liquid beverages in the beverage bottles 10. It is contemplated that the one or more miniature beverage bottles 52 may contain a wide variety of beverages, including liquor, water and carbonated water, flavored syrup and flavored crystals. In the example of a liquor-filled miniature beverage bottle, the user may remove the seal 38 and pour the liquor contents of the one or more miniature beverage bottles 52 into the body portion 16 of the beverage bottle 10 to create a mixed alcoholic beverage. It should be understood by a person skilled in the art of the present invention that a wide variety of liquor beverages may be contained within the one or more miniature beverage bottles 52, including vodka, rum, whiskey and/or rye. It should be further understood that the variety of liquor contained within the one or more miniature beverage bottles 52 may be selected by the beverage manufacturer to complement the liquid beverage contained within the beverage bottle 10.

Figure 5:
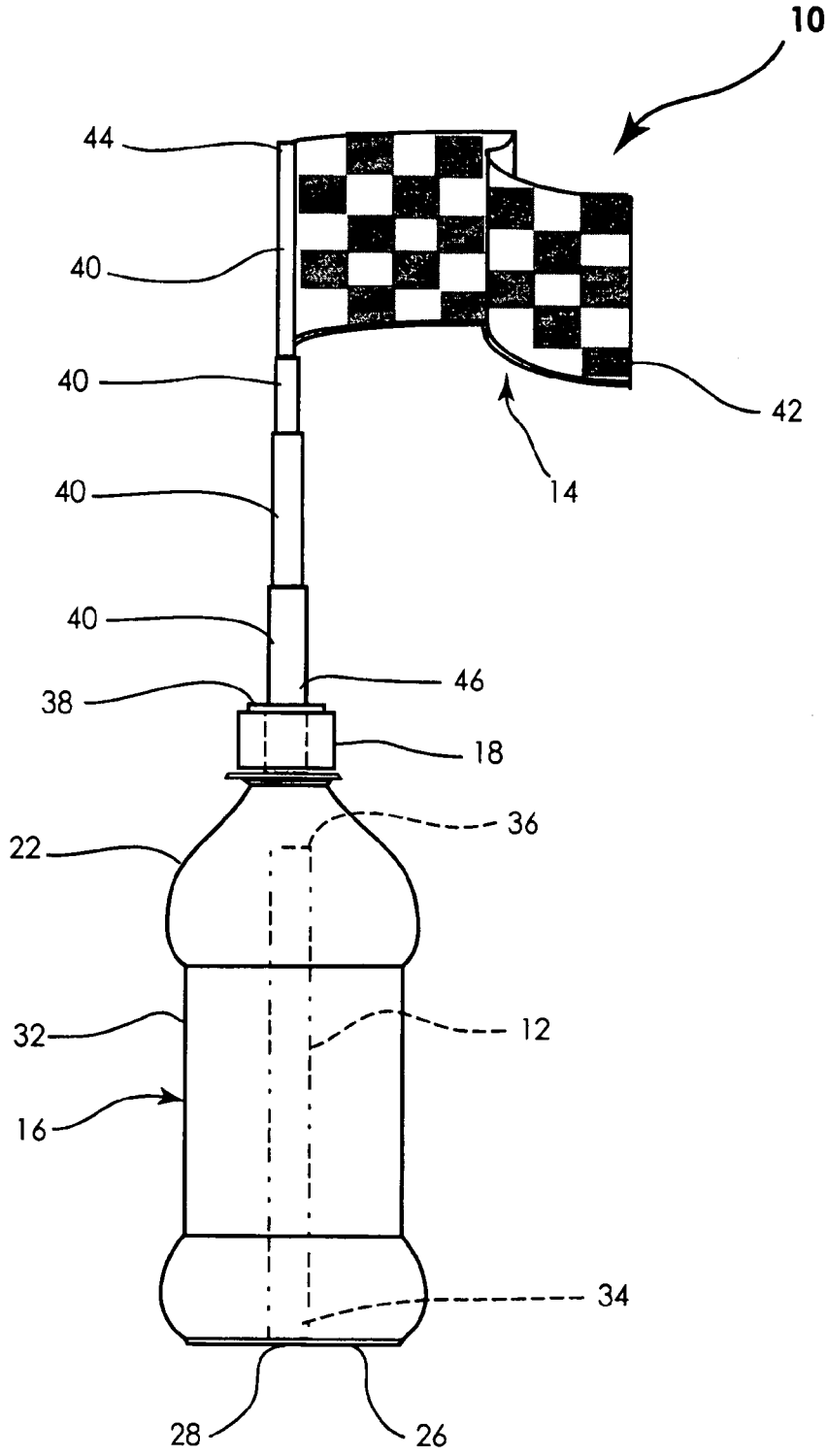
FIG. 5 is a side view of the beverage bottle showing the one or more promotional products removed from the storage compartment and secured to the beverage bottle in accordance with the third embodiment of the present invention.

In a third embodiment of the present invention shown in FIG. 5, a seal or knob, such as seal 38, may be dimensioned to securely fit within the cap 18 on the neck portion 20 of the beverage bottle 10. By this design, the user may remove and secure the promotional product 14 to the cap 18 and comfortably grasp the body portion of the beverage bottle 10 when displaying the promotional product.

When used in the foregoing manner, the beverage bottle of the present invention may be offered and sold by businesses to enable users, such as spectators, to utilize the one or more promotional products and to actively participate in the sporting or entertainment event, for example. The beverage bottle may also be utilized as a business-to-business advertising aid, enabling a liquid beverage business to cross-promote the goods and services of another business by providing advertisements and product samples, for example, within the storage compartment of the beverage bottle. In addition to the various promotional and advertising opportunities that may be pursued using the beverage bottle of the present invention, the beverage bottle may continue to be utilized by a user in a conventional manner to quench their thirst and thereby further enhance their enjoyment of the related business, sporting or entertainment event.

It will be understood that there are to be no limitations as to the dimensions and shape of the beverage bottle 10, including the storage compartment 12 and the one or more promotional products 14 stored therein, or the materials from which the beverage bottle 10 is manufactured. The beverage bottle 10 may be constructed to resemble any commercially available bottle for holding a liquid beverage and may be manufactured from any suitable plastic, glass or metal material. A suitable plastic material may include a polyethylene terephthalate (PET) material. Furthermore, it should be understood that the beverage bottle 10 of the present invention may be adapted to store any suitable liquid, such as, for example, water, juice, milk, carbonated sodas, beer and liquor.

While what has been shown and described herein constitutes a preferred embodiment of the subject invention, it should be understood that various modifications and adaptions of such embodiment can be made without departing from the present invention, the scope of which is defined in the appended claims.

The invention claimed is:

1. A beverage bottle, comprising:

a body portion for containing a liquid beverage, the body portion having a sidewall portion extending between a neck portion and a base portion;

a storage compartment forming a cavity within the body portion, the cavity extending from the base portion vertically towards the neck portion of the body portion;

an open end of said cavity proximate to said base portion;

a closed end of said cavity within said body portion proximate to the neck portion of the body portion;

at least one promotional product disposed and stored within the cavity of the storage compartment, and being removable from said cavity by withdrawing said product through said open end;

a spring biasing mechanism within said cavity of said storage compartment at said closed end operable to urge said promotional product out through said open end of said storage compartment.

2. A beverage bottle as claimed in claim 1, wherein said at least one promotional product comprise a banner adapted to be removed from the storage compartment and unfurled.

3. A beverage bottle as claimed in claim 2, wherein the banner is furled around one or more telescopic members and stored within the storage compartment.

* * * * *